US011152754B2

(12) United States Patent
Saito et al.

(10) Patent No.: US 11,152,754 B2
(45) Date of Patent: Oct. 19, 2021

(54) METHOD OF CRIMPING TERMINAL WITH CABLE AND TERMINAL CRIMPING APPARATUS

(71) Applicant: Yazaki Corporation, Tokyo (JP)

(72) Inventors: Hideki Saito, Shizuoka (JP); Kazuhide Takahashi, Shizuoka (JP); Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 118 days.

(21) Appl. No.: 16/507,546

(22) Filed: Jul. 10, 2019

(65) Prior Publication Data

US 2020/0021074 A1 Jan. 16, 2020

(30) Foreign Application Priority Data

Jul. 12, 2018 (JP) ..... JP2018-132134

(51) Int. Cl.
*H01R 43/04* (2006.01)
*H01R 43/048* (2006.01)
*H01R 4/18* (2006.01)

(52) U.S. Cl.
CPC ..... *H01R 43/048* (2013.01); *H01R 4/185* (2013.01)

(58) Field of Classification Search
CPC .... H01R 43/048; H01R 4/185; H01R 43/005; H01R 4/62; Y10T 29/49174; Y10T 29/49176; Y10T 29/49185; Y10T 29/53209; Y10T 29/53235
USPC ..... 29/857, 858, 863, 747, 753
See application file for complete search history.

(56) References Cited

U.S. PATENT DOCUMENTS

| | | | | |
|---|---|---|---|---|
| 9,368,929 | B2 * | 6/2016 | Matsushita | H01R 11/12 |
| 9,748,724 | B2 * | 8/2017 | Sato | H01R 43/24 |
| 9,954,289 | B2 * | 4/2018 | Miyakawa | H01R 4/70 |
| 2014/0165393 | A1 | 6/2014 | Sato | |

FOREIGN PATENT DOCUMENTS

| | | | |
|---|---|---|---|
| JP | 201343378 | A | 3/2013 |
| JP | 2017-228419 | A | 12/2017 |

* cited by examiner

*Primary Examiner* — Donghai D Nguyen
(74) *Attorney, Agent, or Firm* — Sughrue Mion, PLLC

(57) ABSTRACT

A method of crimping a terminal with a cable which crimps and connects a crimping portion of a crimp terminal to an end of a cable by a crimp die, includes an anticorrosive supply step and a terminal crimping step. In the anticorrosive supply step, an anticorrosive agent is stored in or supplied to an anticorrosive supply portion formed in the crimp die. In the terminal crimping step, the crimping portion of the crimp terminal is crimped to the cable by the crimp die. During or after the terminal crimping step, the anticorrosive agent is applied to a predetermined area around the crimping portion of the crimp terminal by the anticorrosive supply portion of the crimp die.

4 Claims, 12 Drawing Sheets

METHOD OF CRIMPING TERMINAL WITH CABLE AND TERMINAL CRIMPING APPARATUS

CROSS REFERENCE TO RELATED APPLICATION

This application is based upon and claims the benefit of priority from the prior Japanese Patent Application No. 2018-132134, filed on Jul. 12, 2018, the entire contents of which are incorporated herein by reference.

BACKGROUND

1. Technical Field

The present invention relates to a method of crimping a terminal with a cable subjected to anticorrosion treatment and a terminal crimping apparatus.

2. Related Art

For example, a method of manufacturing a terminal with a cable subjected to anticorrosion treatment has been disclosed in Patent Literature 1 (JP 2017-228419 A). In the method of manufacturing a terminal with a cable, a terminal with a cable is manufactured by a cable manufacturing apparatus which includes a conveying device, a crimp unit, an inspection unit, a heating unit, a jet dispenser, a resin curing unit, an inspection unit, and the like.

The conveying device conveys the cable to be manufactured to each step. It is to be noted that a sheathed lead wire and a terminal which are crimped to each other in a state before a resin member is applied and cured, are called a pre-resin sheathed cable.

The crimp unit crimps the terminal and the sheathed lead wire by a die. The crimp unit may crimp the terminal and the sheathed lead wire in a step separate from the conveying device. The inspection unit inspects the crimped state. When the crimp unit crimps the terminal and the sheathed lead wire on a line separate from the conveying device, the inspection unit inspects the crimped state on the line.

The heating unit heats the terminal. It is possible to suppress a decrease in fluidity of an applied resin member by heating the terminal with the heating unit. The jet dispenser applies the resin member in the vicinity of a crimping portion so as to cover at least the lead wire (core wire) exposed from the sheathed portion. The jet dispenser can be operated at a high speed.

The resin curing unit irradiates the resin member with ultraviolet rays while conveying the pre-resin sheathed cable to which the resin member is applied. The resin curing unit irradiates ultraviolet rays in the same line as the jet dispenser after the jet dispenser applies the resin member in the vicinity of the crimping portion, thereby making it possible to cure the resin member. The inspection unit inspects a shape, a film thickness, and the like of the cured resin member. As described above, the pre-resin sheathed cable moves to each device by the conveying device and is sequentially subjected to each of the above-described steps, thereby manufacturing a terminal with a cable.

SUMMARY

However, the conventional method of manufacturing a terminal with a cable has a problem in that each step is provided independently and therefore a manufacturing line becomes long. In addition, since each step takes time, productivity is reduced and cost is increased.

An object of the present invention is to provide a high-productivity and inexpensive method of crimping a terminal with a cable, and a terminal crimping apparatus in which anticorrosion treatment is performed on a core wire of a cable exposed from an insulating sheath within the terminal crimping apparatus in a short time.

According to an embodiment, there is provided a method of crimping a terminal with a cable which includes: a cable having a core wire covered with an insulating sheath; and a crimp terminal having a crimping portion including: a core wire crimping portion crimped to the core wire exposed from the insulating sheath; and a sheath crimping portion crimped to the insulating sheath, and wherein the method crimps and connects the crimping portion of the crimp terminal to an end of the cable by a crimp die, the method comprising: an anticorrosive supplying step of storing an anticorrosive agent in or supplying an anticorrosive agent to an anticorrosive supply portion formed in the crimp die; and a terminal crimping step of crimping the crimping portion of the crimp terminal to the cable by the crimp die, wherein during or after the terminal crimping step, the anticorrosive agent is applied to a predetermined area around the crimping portion of the crimp terminal by the anticorrosive supply portion of the crimp die.

According to an embodiment, there is provided a terminal crimping apparatus used for a method of crimping a terminal with a cable which including: a cable having a core wire covered with an insulating sheath; and a crimp terminal having a crimping portion including: a core wire crimping portion crimped to the core wire exposed from the insulating sheath; and a sheath crimping portion crimped to the insulating sheath, and the apparatus comprising: a crimp die which crimps and connects the crimping portion of the crimp terminal to an end of the cable; and, an anticorrosive supply portion which is provided to the crimp die and supplies an anticorrosive agent to a predetermined area around the crimping portion of the crimp terminal.

According to the embodiments, an anticorrosive agent can be applied by transfer or dropping during or after the crimping of the crimp terminal. Therefore, the core wire of the cable exposed from the insulating sheath within the terminal crimping apparatus, can be subjected to the anticorrosion treatment in a short time, which achieves the improvement in productivity and cost reduction of the terminal with a cable subjected to the anticorrosion treatment.

DETAILED DESCRIPTION

Hereinafter, embodiments of the present invention will be described with reference to the accompanying drawings.

A first embodiment will be described with reference to FIGS. 1 to 13.

Figure 1:
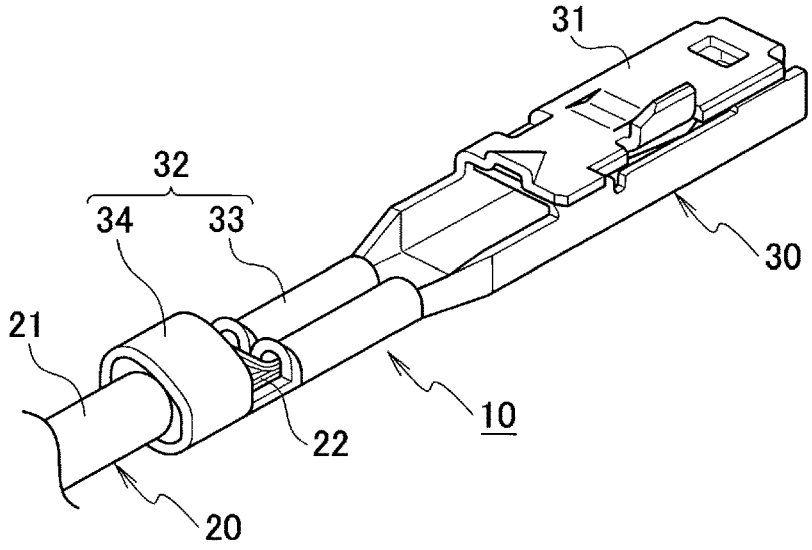
FIG. 1 is a perspective view of a terminal with a cable according to a first embodiment of the present invention.
Figure 2:
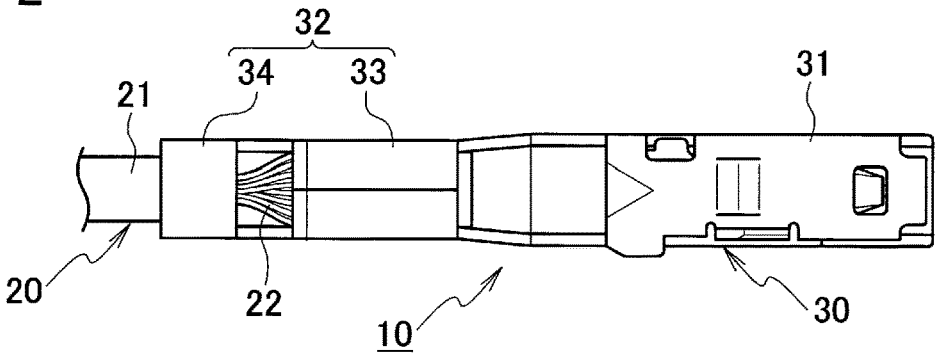
FIG. 2 is a plan view of the terminal with a cable.
Figure 3:
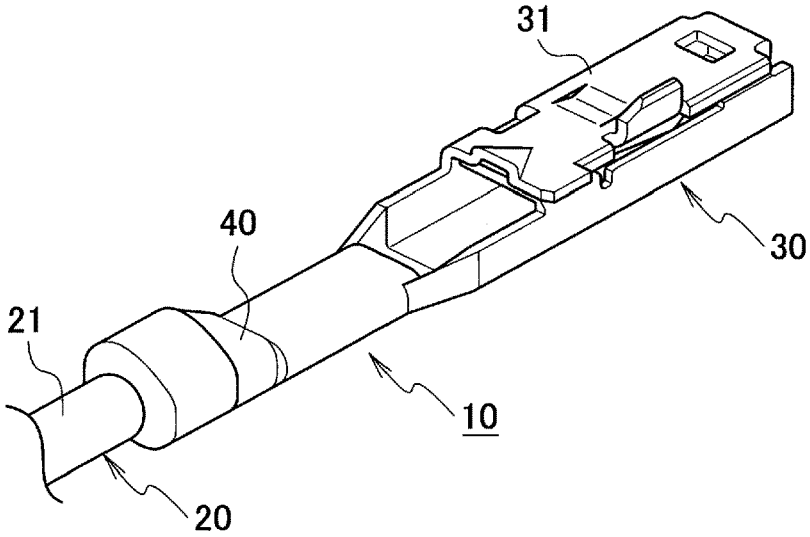
FIG. 3 is a perspective view of the terminal with a cable subjected to anticorrosion treatment.
Figure 4:
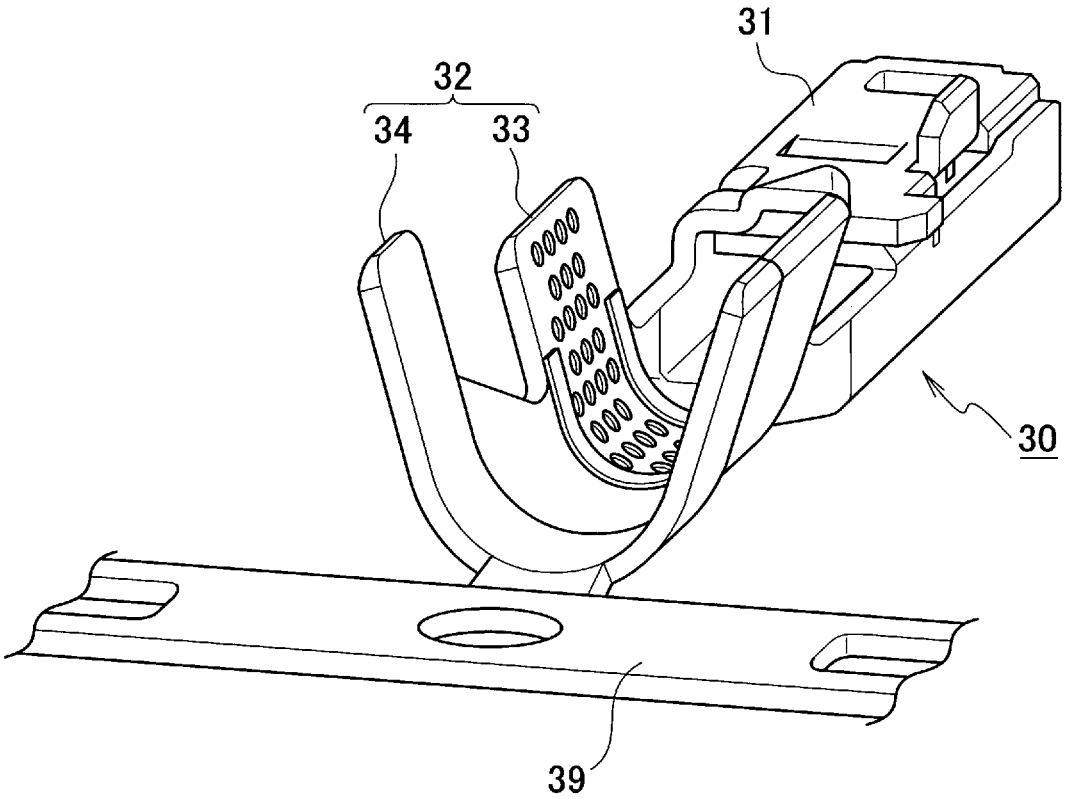
FIG. 4 is a perspective view of a chain terminal before a crimp connection of a cable supplied to a crimp die.

As illustrated in FIGS. 1 and 2, a terminal 10 with a cable includes a cable 20 and a crimp terminal 30 made of metal. In the cable 20, a core wire 22 is covered with an insulating sheath 21. The crimp terminal 30 has a box-shaped terminal connection portion 31 and a crimping portion 32.

The terminal connection portion 31 is formed on a front side of the crimp terminal 30. The other terminal is electrically connected to the terminal connection portion 31. The crimping portion 32 has a core wire barrel (core wire crimping portion) 33 and a sheathed barrel (sheath crimping portion) 34. The core wire barrel 33 is crimped to the core wire 22 exposed from the insulating sheath 21 at a rear side from a center of the crimp terminal 30. The sheathed barrel 34 is crimped to the insulating sheath 21.

An anticorrosive agent 40 is applied around the crimping portion 32 of the crimp terminal 30 via a terminal crimping apparatus 50 having a crimp die 60 to cover the crimping portion 32.

In the terminal 10 with a cable, the core wire 22 of the cable 20 and the crimp terminal 30 are each made of different metals. For example, the core wire 22 is formed of a wire rod of aluminum or an aluminum alloy. The crimp terminal 30 is made of a member in which a base material of a copper alloy is plated with a tin alloy or the like. In this case, a bare portion of the core wire 22 in contact with the crimp terminal 30 is likely to be electrolytically corroded (corroded) due to different metal contact corrosion (galvanic corrosion). Therefore, the anticorrosive agent 40 is applied between the core wire barrel 33 and the sheathed barrel 34 of the crimping portion 32 of the crimp terminal 30 where the bare portion of the core wire 22 is exposed, thereby preventing electrolytic corrosion (see FIG. 3).

Examples of the anticorrosive agent 40 include a liquid ultraviolet curable resin such as urethane acrylate or a liquid thermoplastic resin such as polyethylene, polypropylene, polystyrene, polyvinyl chloride, polyester, and polyamide.

When an ultraviolet curable resin or a thermoplastic resin is used as the anticorrosive agent 40, there are two methods for applying the anticorrosive agent 40.

Figure 5A:
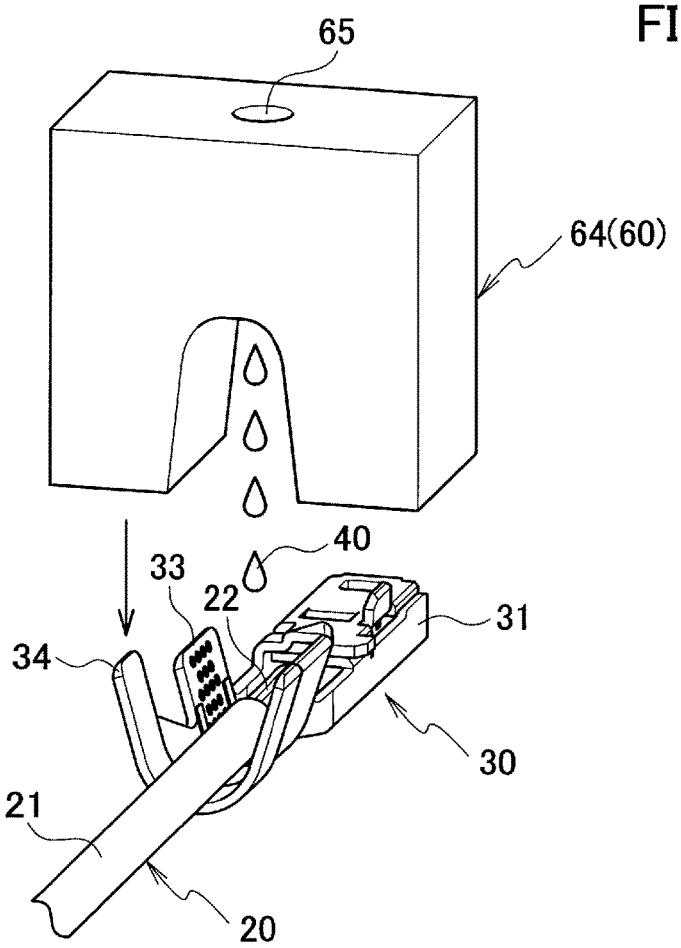
FIG. 5A is a perspective view schematically illustrating a state in which an anticorrosive agent is applied to the terminal by the crimp die.

In both methods, as illustrated in FIG. 5A, the crimping portion 32 is subjected to bending, and the crimp terminal (chain terminal) 30 (see FIG. 4) connected to a connecting band 39 is conveyed immediately below an upper die 64 which also serves as an application unit of the crimp die 60. In FIG. 5A, the illustration of the connecting band 39 is omitted.

Figure 5B:
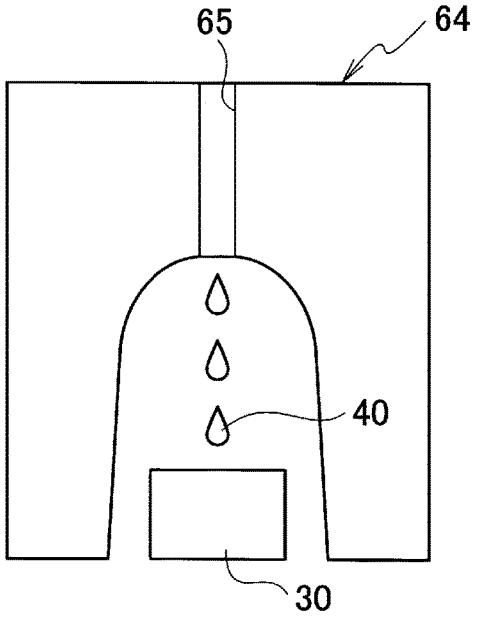
FIG. 5B is an explanatory view schematically illustrating application of the anticorrosive agent by dropping.

In the first method, during or after the terminal crimping step in which the crimping portion 32 of the crimp terminal 30 is crimped to an end of the cable 20 by the crimp die 60, in an anticorrosive supplying step of storing or supplying the anticorrosive agent 40, as illustrated in FIG. 5B, the liquid anticorrosive agent 40 stored in an anticorrosive supply portion 65 of the upper die 64 drops into a predetermined area around the core wire barrel 33 of the crimp terminal 30 by a fixed amount to be applied to the predetermined area.

Figure 5C:
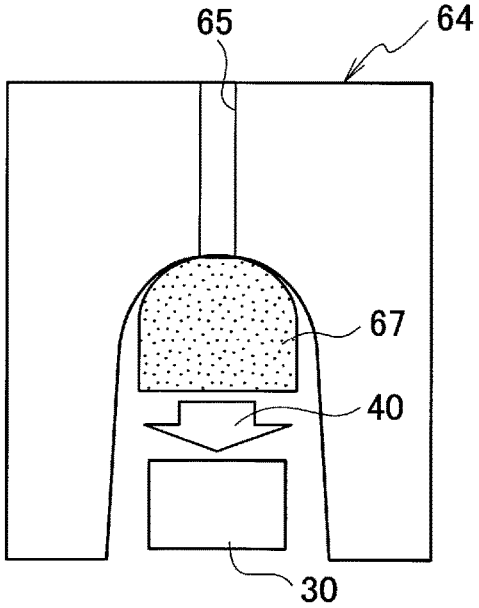
FIG. 5C is an explanatory view schematically illustrating the application of the anticorrosive agent by transfer.

In the second method, during or after the terminal crimping step, in the anticorrosive supplying step, as illustrated in FIG. 5C, the anticorrosive agent 40 is transferred and applied to the predetermined area around the core wire barrel 33 of the crimp terminal 30 by a porous body (anticorrosive supply portion) 67 such as a sponge in which the liquid anticorrosive agent 40 is soaked.

Figure 5D:
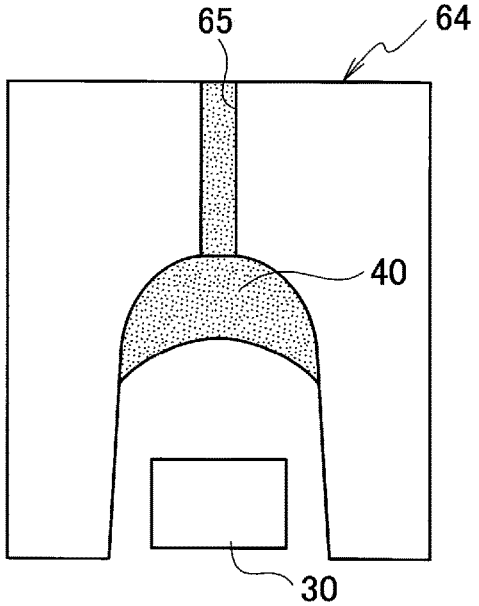
FIG. 5D is an explanatory view schematically illustrating a case where the anticorrosive agent is applied in a film shape by a surface tension of the anticorrosive agent.

In both methods, it is preferable to drop or transfer and apply the anticorrosive agent 40 to the portion to which the core wire 22 between the core wire barrel 33 and the sheathed barrel 34 of the crimp terminal 30 is exposed. As illustrated in FIG. 5D, the anticorrosive agent 40 may be applied in a film form by a surface tension of the anticorrosive agent 40.

Figure 6:
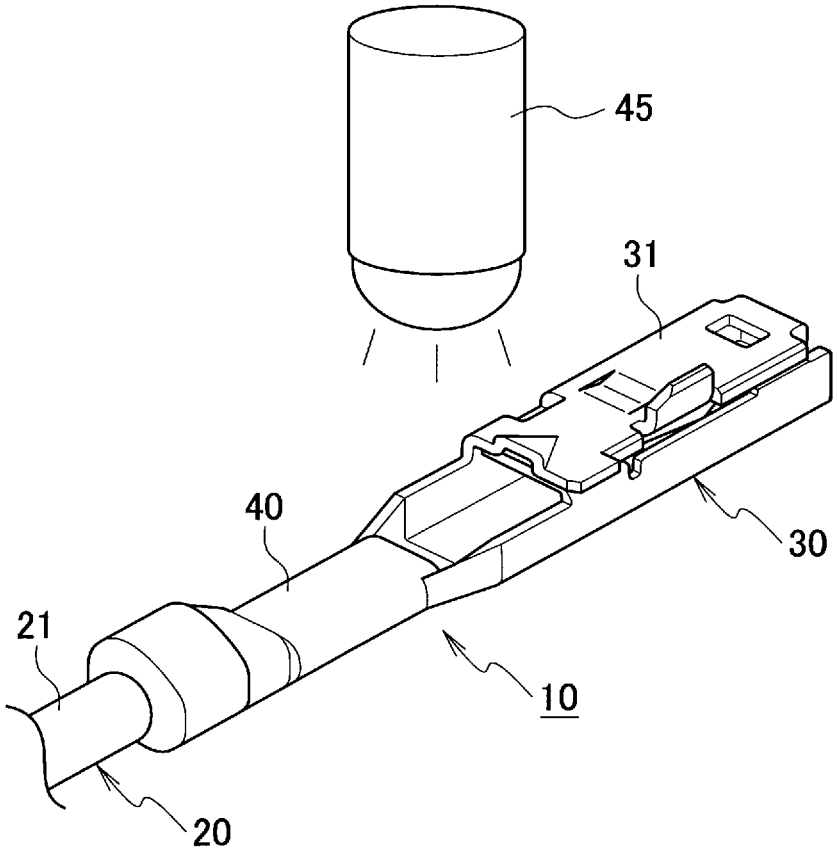
FIG. 6 is a perspective view of the terminal with a cable at the time of curing the anticorrosive agent applied to the terminal with a cable.
Figure 7:
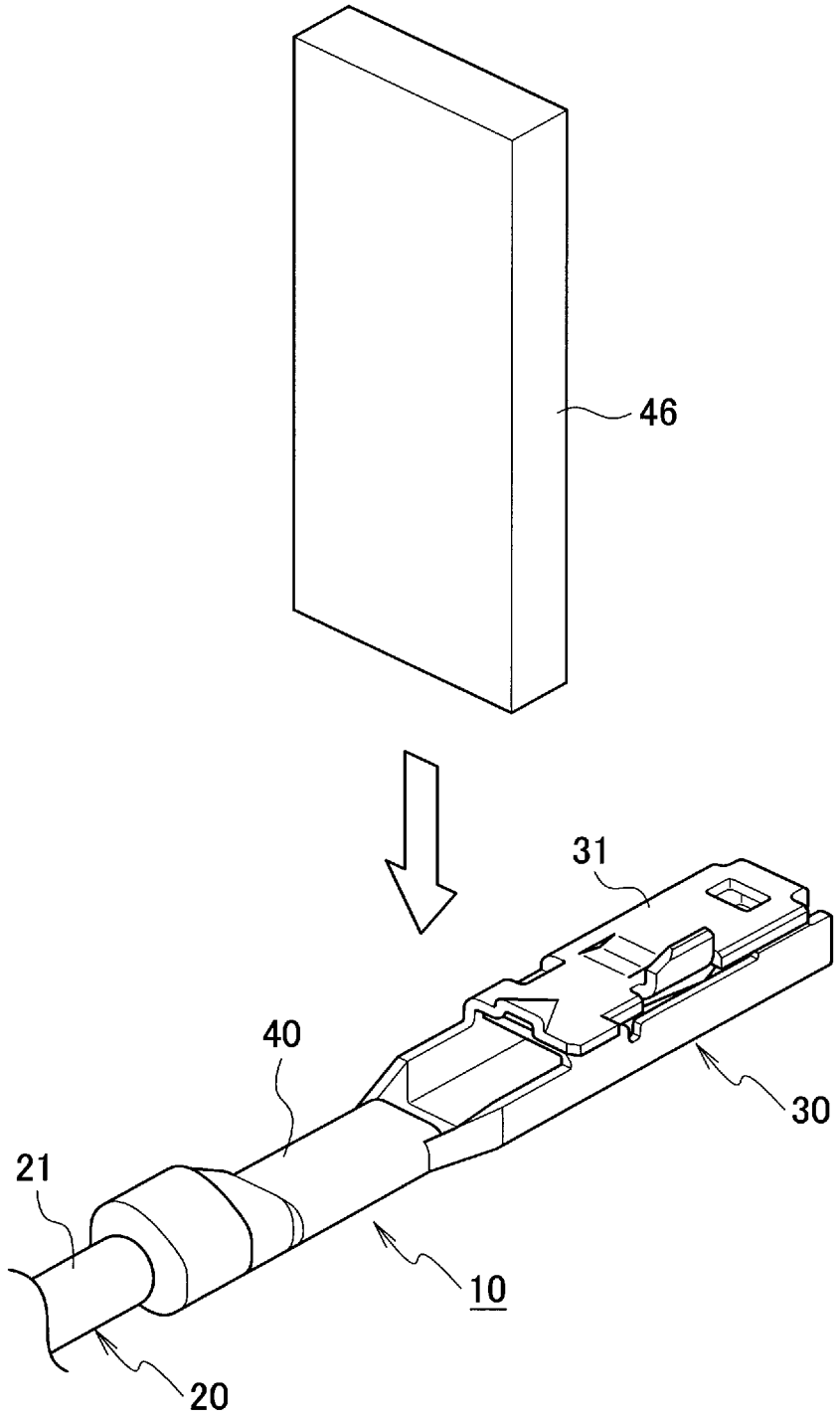
FIG. 7 is a perspective view of the terminal with a cable at the time of inspecting the cured state of the anticorrosive agent.

When an ultraviolet curable resin is used as the anticorrosive agent 40, as illustrated in FIGS. 6 and 7, UV irradiation step of irradiating the anticorrosive agent 40 with ultraviolet rays (UV light) for UV curing and an inspection step of inspecting the cured state are provided.

In the UV irradiation step, as illustrated in FIG. 6, for example, the anticorrosive agent 40 is cured in a short time when receiving energy from the UV irradiation of the UV light 45. After the curing of the anticorrosive agent 40, in the inspection step, as illustrated in FIG. 7, the cured state of the anticorrosive agent 40 is inspected using, for example, a camera 46 or the like. If the cured state of the anticorrosive agent 40 is good, the manufacturing of the terminal 10 with a cable in which the predetermined area around the crimping portion 32 of the crimp terminal 30 is covered with the anticorrosive agent (that is, the crimp terminal 30 is subjected to anticorrosion treatment) is completed.

Figure 8:
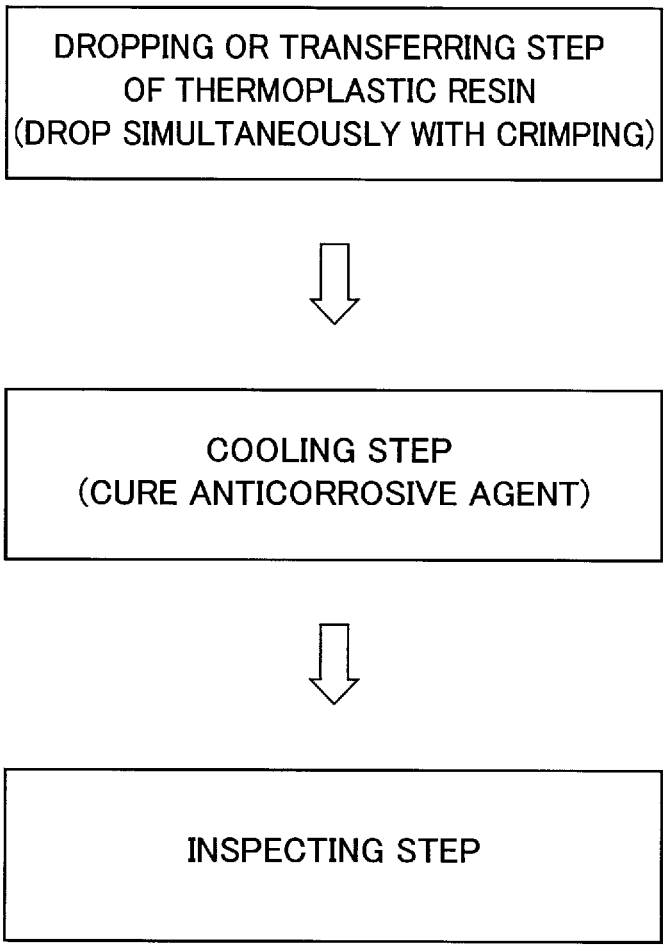
FIG. 8 is a flowchart sequentially illustrating an application step to an inspection step when the anticorrosive agent is a thermoplastic resin.

When the thermoplastic resin is used as the anticorrosive agent 40, as illustrated in FIG. 8, a step of dropping or transferring the thermoplastic resin, a cooling step of curing the thermoplastic resin, and an inspection step of inspecting the cured state are provided. The thermoplastic resin may be dropped simultaneously with crimping the crimp terminal 30. In addition, the cured state can be inspected simultaneously with the cooling step.

Figure 9:
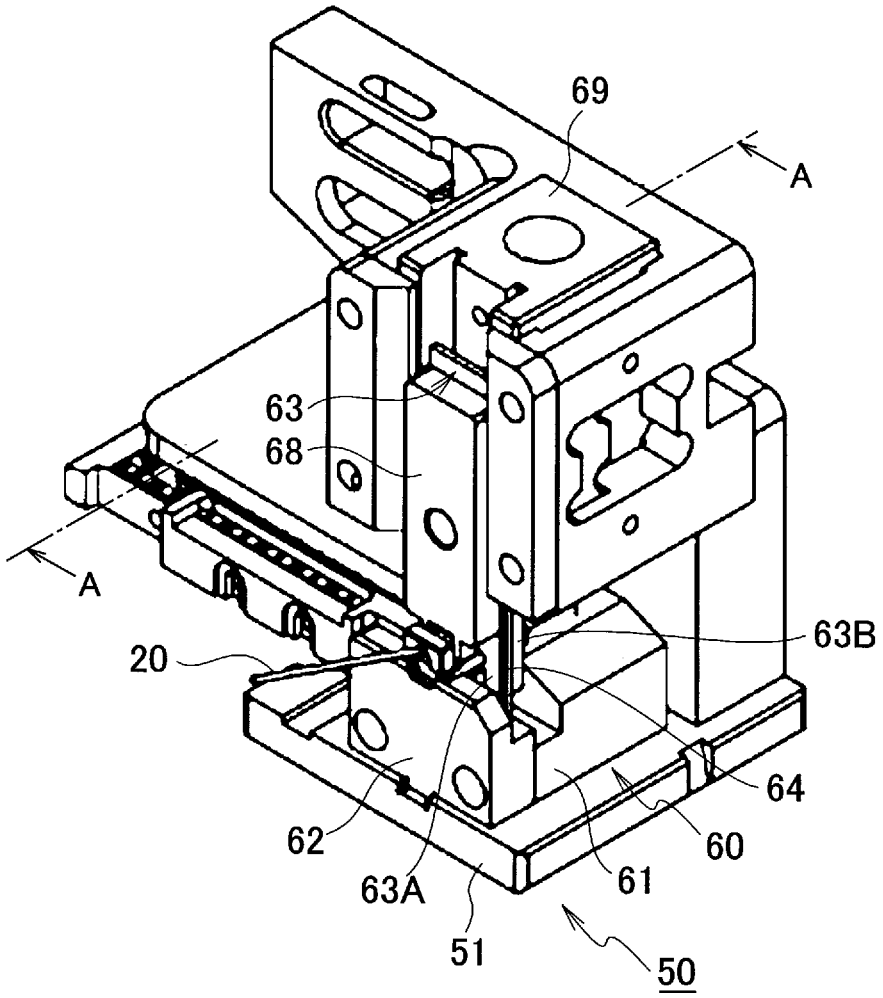
FIG. 9 is a perspective view of a terminal crimping apparatus for crimping the terminal with a cable.

In the method of crimping a terminal 10 with a cable by the crimp die 60, a terminal crimping apparatus 50 illustrated in FIG. 9 is used.

As illustrated in FIGS. 9 to 13, the terminal crimping apparatus 50 crimps and connects the crimp terminal 30 to the end of the cable 20 by caulking the crimp terminal 30 to the end of the cable 20. The terminal crimping apparatus 50 has the crimp die 60 on a base 51. The crimp die 60 includes an anvil 61 as a fixed lower die and a movable upper die 63 which moves up and down with respect to the anvil 61. A cable setting table 62 is provided on a front side of the anvil 61. The movable upper die 63 has a middle upper die 64 between front and rear crimpers 63A and 63B. A cable pressing body 68 and a terminal connection portion pressing body 69 are provided before and after the crimpers 63A and 63B and the middle upper die 64.

The anvil (fixed lower die) 61 and the crimper 63A on the front side of the movable upper die 63 caulk and crimp a U-shaped sheathed barrel 34 of the crimp terminal 30 to the insulating sheath 21 of the cable 20 such that the sheathed barrel 34 is wound around the insulating sheath 21, by narrowing a gap between the anvil 61 and the crimper 63A.

The anvil 61 and the crimper 63B on the rear side of the movable upper die 63 caulk and crimp a U-shaped core wire barrel 33 of the crimp terminal 30 to the core wire 22 of the cable 20 such that the core wire barrel 33 is wound around the core wire 22 of the cable 20 by narrowing a gap between the anvil 61 and the crimper 63B.

In crimping the end of the cable 20 to the crimping portion 32 of the crimp terminal 30, the insulating sheath 21 of the cable 20 is held between the cable setting table and the cable pressing body 68 and the terminal connection portion 31 of the crimp terminal 30 is held by the terminal connection portion pressing body 69.

A lower surface side of the middle upper die 64 of the movable upper die 63 is recessed in an inverted U shape. In order to supply the anticorrosive agent 40 to a predetermined area around the crimping portion 32 of the crimp terminal 30, a hole-shaped anticorrosive supply portion 65 is provided on an upper side of the middle upper die 64. The anticorrosive supply portion 65 stores the anticorrosive agent 40 therein. An outlet 65*a* at a center of a lower end of the anticorrosive supply portion 65 is provided at a position facing the portion where the core wire 22 is exposed between the core wire barrel 33 and the sheathed barrel 34 of the crimping portion 32 of the crimp terminal 30 which is set on the anvil 61.

The liquid anticorrosive agent 40 stored in the anticorrosive supply portion 65 is dropped and applied to the portion where the core wire 22 is exposed between the core wire barrel 33 and the sheathed barrel 34 of the crimp terminal 30 by a fixed amount through the outlet 65*a* of the anticorrosive supply portion 65.

Figure 13:
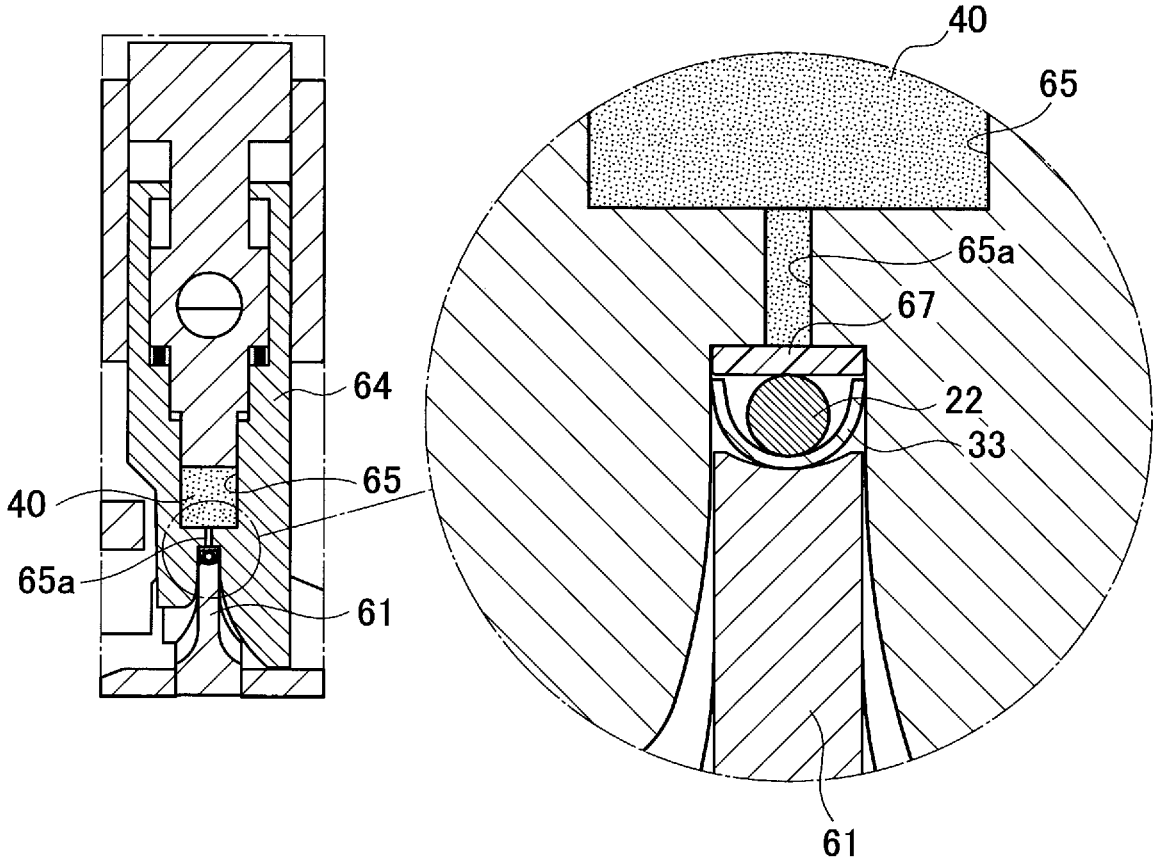
FIG. 13 is a cross-sectional view taken along the line D-D in FIG. 12A at the end of transfer of the anticorrosive agent by the terminal crimping apparatus.

As illustrated in FIG. 13, the porous body (anticorrosive supply portion) 67 such as a sponge in which the liquid anticorrosive agent 40 is soaked may also be provided on a ceiling surface side of the inverted U-shaped recess on the lower surface side of the middle upper die 64 of the movable upper die 63. As described above, the liquid anticorrosive agent 40 may be transferred and applied to the portion where the core wire 22 is exposed between the core wire barrel 33 and the sheathed barrel 34 of the crimp terminal 30, using the porous body 67.

Next, the method of crimping a terminal 10 with a cable for crimping and connecting the crimping portion 32 of the crimp terminal 30 to the end of the cable 20 by the crimp die 60 of the terminal crimping apparatus 50 will be specifically described in order along FIGS. 10A to 13.

Figure 10A:
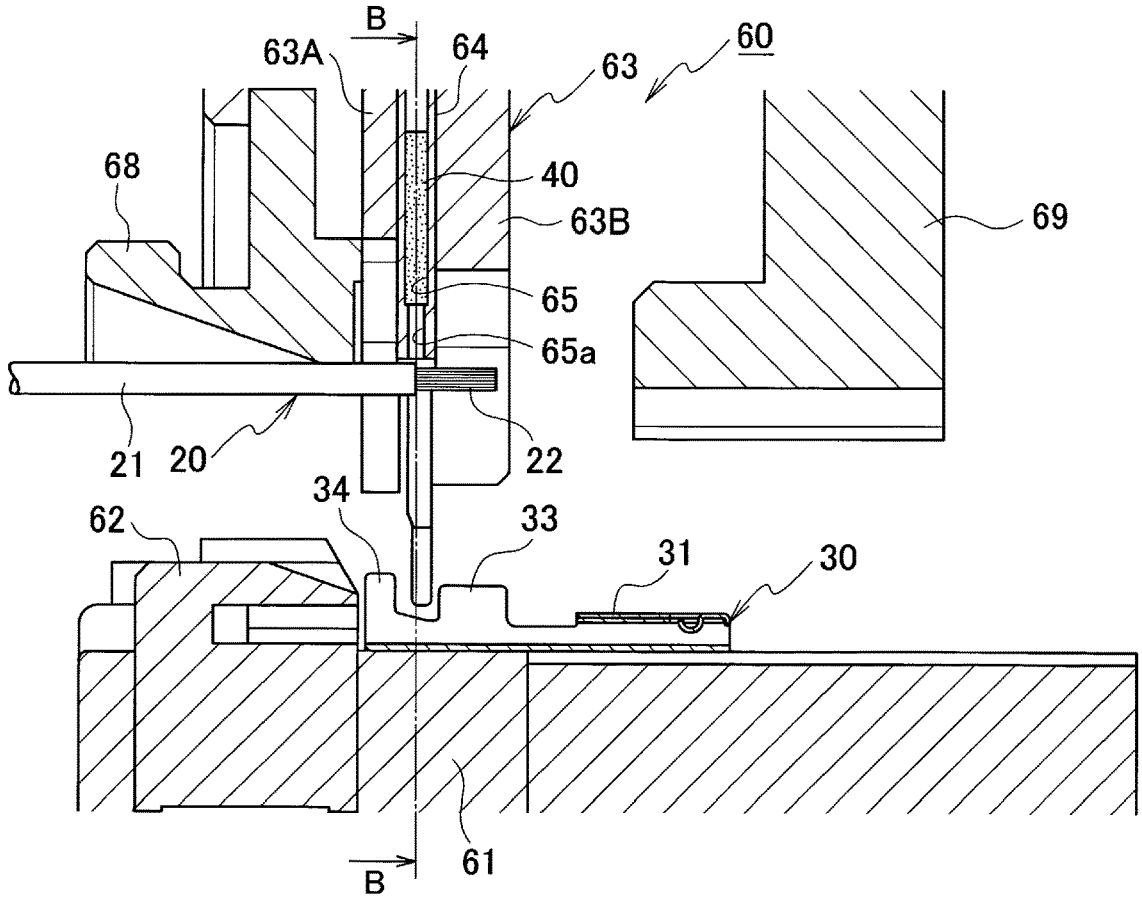
FIG. 10A is a cross-sectional view taken along the line A-A in FIG. 9 at the start of crimping of the terminal crimping apparatus.
Figure 10B:
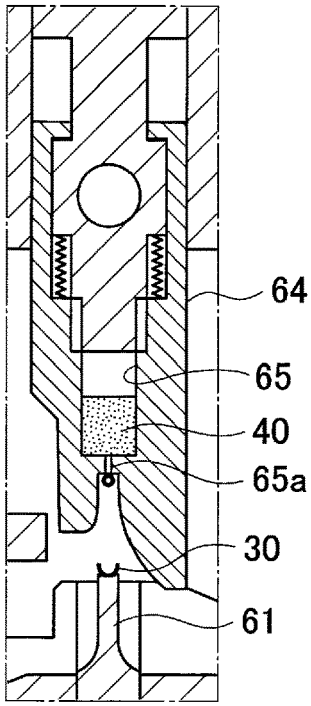
FIG. 10B is a cross-sectional view taken along the line B-B in FIG. 10A.

First, as illustrated in FIGS. 10A and 10B, the crimp terminal (chain terminal) 30 which is bent and connected to the connecting band 39 (not illustrated) is set on the anvil 61 which is the fixed lower die of the crimp die 60 and set on the lower side of the movable upper die 63.

Figure 11A:
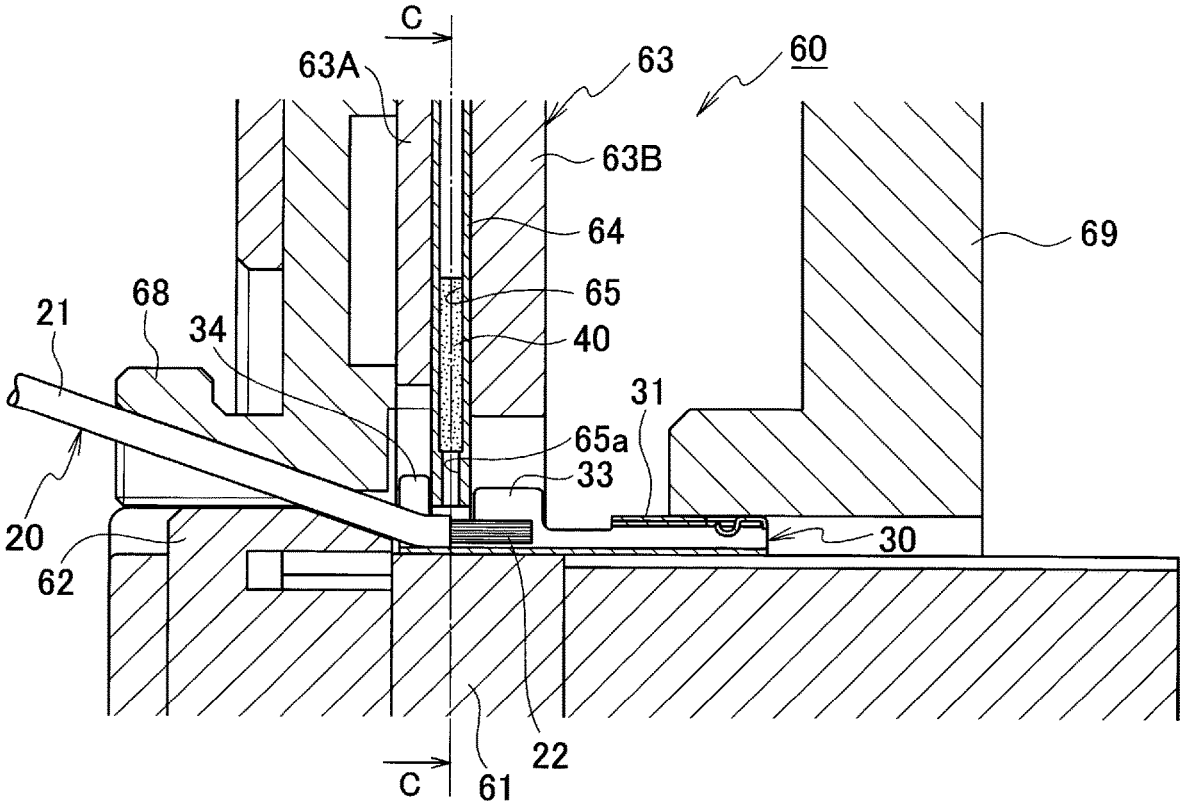
FIG. 11A is a cross-sectional view taken along the line A-A in FIG. 9 at the start of dropping of the anticorrosive agent by the terminal crimping apparatus.
Figure 11B:
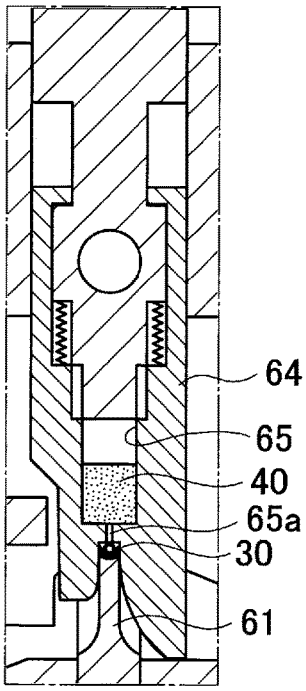
FIG. 11B is a cross-sectional view taken along the line C-C in FIG. 11A.

Next, as illustrated in FIGS. 11A and 11B, the movable upper die 63 descends to crimp the core wire barrel 33 of the crimp terminal 30 to the core wire 22 exposed from the insulating sheath 21 of the cable 20 and crimp the sheathed barrel 34 to the insulating sheath 21 of the cable 20, between the anvil 61 and the crimpers 63A and 63B on the front and rear sides of the movable upper die 63

At the same time, the anticorrosive agent 40 starts to be dropped toward the portion where the core wire 22 is exposed between the core wire barrel 33 and the sheathed barrel 34 of the crimp terminal 30. At the time of starting the crimping, the liquid anticorrosive agent 40 may be transferred and applied to the portion where the core wire 22 is exposed between the core wire barrel 33 and the sheathed barrel 34 of the crimp terminal 30 by using the porous body 67 which is provided on the lower surface side of the middle upper die 64 of the movable upper die 63 and soaked with the liquid anticorrosive agent 40.

Figure 12A:
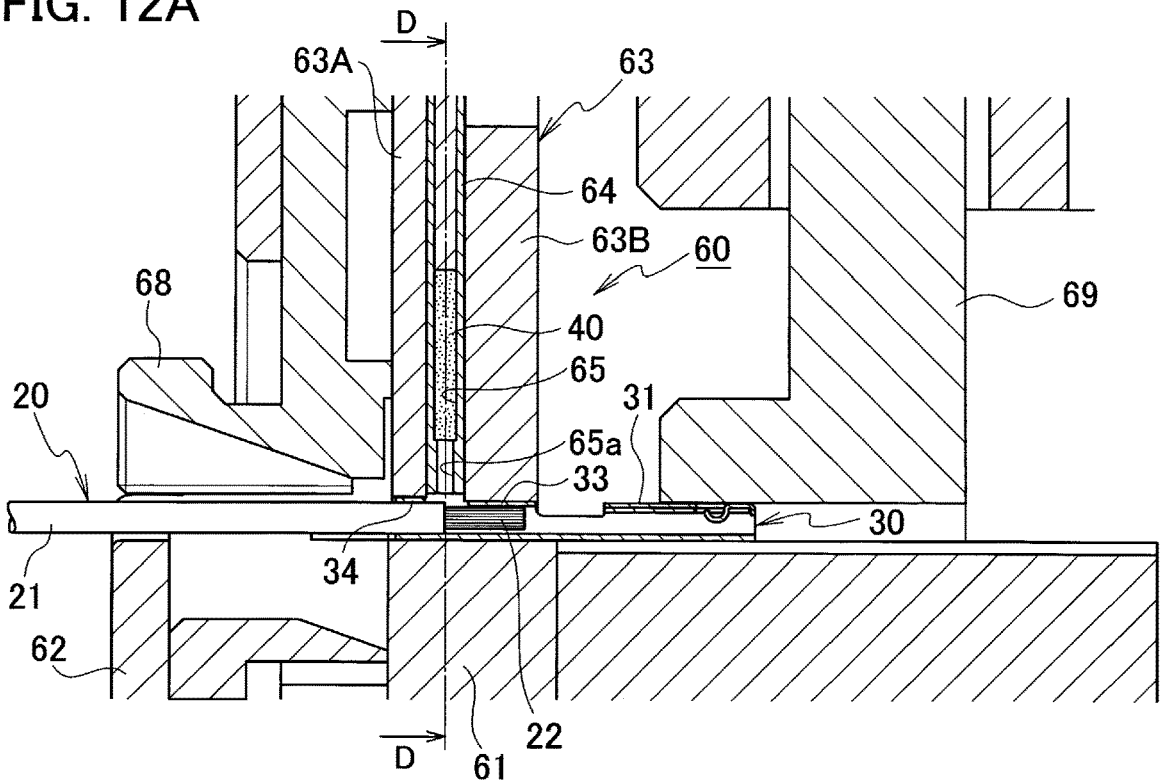
FIG. 12A is a cross-sectional view taken along the line A-A in FIG. 9 at the end of dropping of the anticorrosive agent by the terminal crimping apparatus.
Figure 12B:
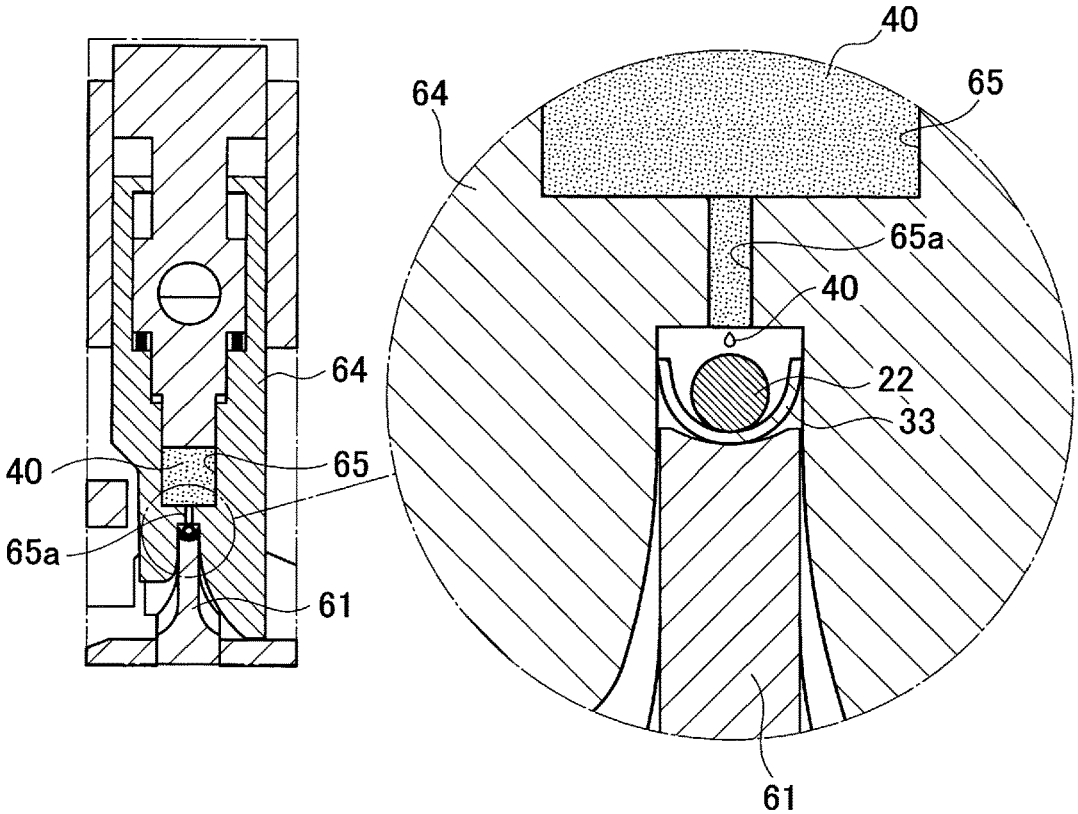
FIG. 12B is a cross-sectional view taken along the line D-D in FIG. 12A.

As illustrated in FIGS. 12A and 12B and FIG. 13, the crimping and connecting of the crimping portion 32 of the crimp terminal 30 to the end of the cable 20 are completed, and at the same time the dropping or transfer of the liquid anticorrosive agent 40 to the portion where the core wire is exposed between the core wire barrel 33 and the sheathed barrel 34 of the crimp terminal 30 is completed. As a result, the liquid anticorrosive agent 40 penetrates into and is applied to the peripheral area of the crimping portion 32 of the crimp terminal 30, such that the exposed portion of the core wire 22 of the cable 20 is covered with the anticorrosive agent 40 and is prevented from electrolytic corrosion (different metal contact corrosion).

As described above, since the anticorrosive agent 40 can be applied by the transfer or dripping during the crimping of the crimp terminal 30, that is, simultaneously with crimping the crimp terminal 30, the core wire 22 of the cable 20 exposed from the insulating sheath 21 within the terminal crimping apparatus 50 can be subjected to the anticorrosion treatment in a short time. Thereby, the improvement in productivity and the cost reduction of the terminal 10 with a cable which is subjected to the anticorrosion treatment can be achieved.

A second embodiment will be described with reference to FIG. 14.

Figure 14:
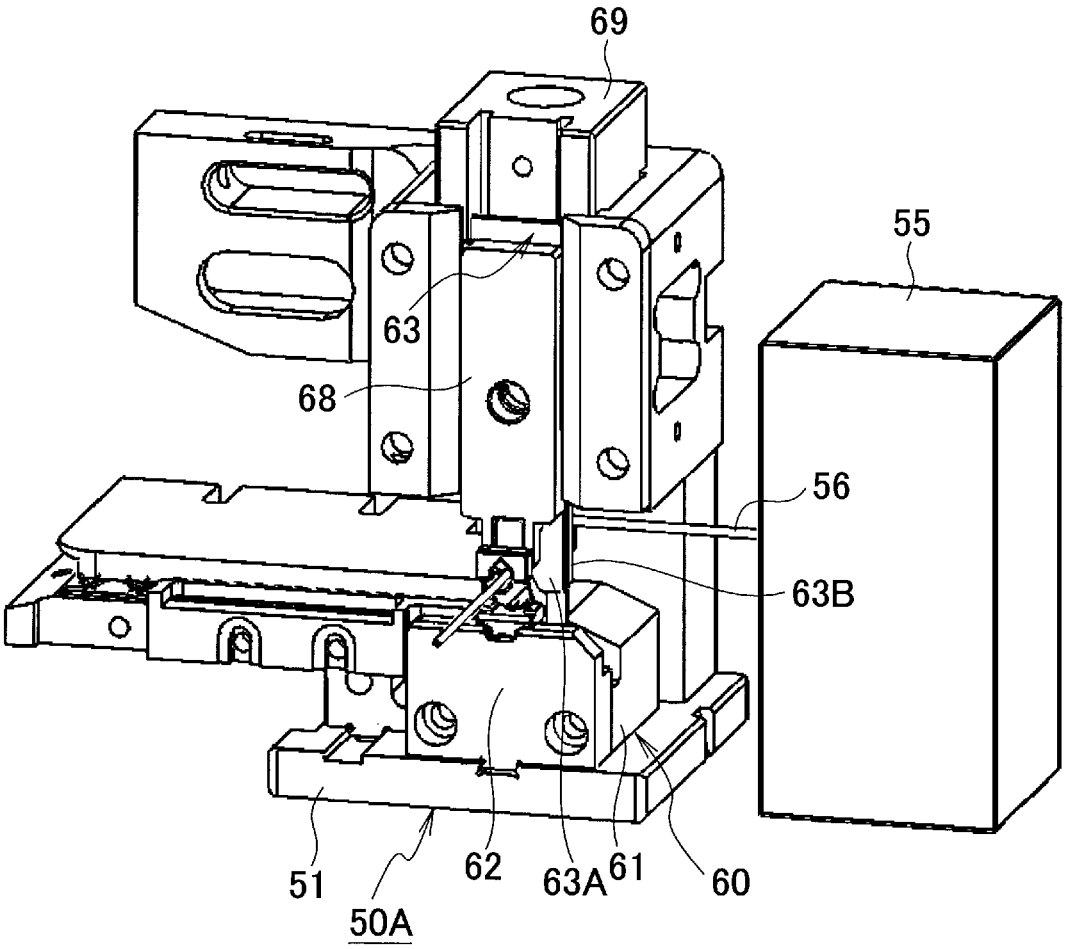
FIG. 14 is a perspective view of a terminal crimping apparatus according to a second embodiment of the present invention.

As illustrated in FIG. 14, a terminal crimping apparatus 50A is different from the terminal crimping apparatus 50 according to the first embodiment in that a supply pipe 56 of a dispenser 55 as a liquid quantitative discharge device is connected to a crimp die 60. Since other configurations are the same as those of the first embodiment, the same reference numerals are given to the same components and the detailed description is omitted.

In the terminal crimping apparatus 50A, after bottom dead centers of the crimpers 63A and 63B on the front and rear sides which are a movable upper die 63 of the crimp die 60 are detected, a fixed amount of liquid anticorrosive agent 40 is accurately supplied from the dispenser 55. For this reason, anticorrosion treatment can be performed with higher accuracy, and a high-quality terminal 10 with a cable can be mass-produced. This can reduce the manufacturing cost.

According to the first and second embodiments, the liquid anticorrosive agent is applied by being dropped or transferred to a portion where a core wire is exposed between a core wire barrel and a sheathed barrel of a crimping portion of a crimp terminal, but these embodiments are not limited thereto. For example, a liquid anticorrosive agent may be applied by being dropped or transferred to the portion or the like where the core wire is exposed between a terminal connection portion of the crimp terminal and the core wire barrel.

In addition, the anticorrosive agent is applied by the dropping or transfer during the crimping of the crimp terminal, that is, simultaneously with the crimping of the crimp terminal, but the embodiment is not limited thereto. For example, the anticorrosive agent may be applied by the dropping or transfer after the crimping of the crimp terminal.

In addition, the anticorrosive supply portion which stores or supplies the anticorrosive agent, is provided to the middle upper die positioned between the crimpers on the front and rear sides of the movable upper die, but this embodiment is not limited thereto. For example, the anticorrosive supply portion may be provided at another location of the movable upper die.

What is claimed is:

1. A method of crimping a terminal with a cable which includes:

a cable having a core wire covered with an insulating sheath; and a crimp terminal having a crimping portion including:

a core wire crimping portion crimped to the core wire exposed from the insulating sheath; and a sheath crimping portion crimped to the insulating sheath, and wherein the method crimps and connects the crimping portion of the crimp terminal to an end of the cable by a crimp die, the method comprising:

an anticorrosive supplying step of storing an anticorrosive agent in or supplying an anticorrosive agent to an anticorrosive supply portion formed in the crimp die; and a terminal crimping step of crimping the crimping portion of the crimp terminal to the cable by the crimp die, wherein during or after the terminal crimping step, the anticorrosive agent is transferred directly or dropped directly to a portion where the core wire is exposed between the core wire crimping portion and the sheath crimping portion of the crimp terminal by the anticorrosive supply portion of the crimp die.

2. The method of crimping the terminal with a cable according to claim 1, wherein the anticorrosive supply portion is a porous body in which a liquid anticorrosive agent is soaked, and the anticorrosive agent is transferred to the predetermined area around the core wire crimping portion of the crimp terminal by the porous body.

3. The method of crimping the terminal with a cable according to claim 1, wherein the anticorrosive supply portion supplies a fixed amount of the stored liquid anticorrosive agent, and the stored liquid anticorrosive agent is dropped to the predetermined area around the core wire crimping portion of the crimp terminal.

4. A terminal crimping apparatus used for a method of crimping a terminal with a cable, which including:

a cable having a core wire covered with an insulating sheath; and a crimp terminal having a crimping portion including:

a core wire crimping portion crimped to the core wire exposed from the insulating sheath; and a sheath crimping portion crimped to the insulating sheath, and the apparatus comprising:

a crimp die which crimps and connects the crimping portion of the crimp terminal to an end of the cable; and, an anticorrosive supply portion which is provided at the position directly facing a portion where the core wire is exposed between the core wire crimping portion and the sheath crimping portion of the crimp terminal in the crimp die and which supplies an anticorrosive agent.

* * * * *